United States Patent [19]

Chuang

[11] Patent Number: 4,858,631

[45] Date of Patent: Aug. 22, 1989

[54] SIMULATED EYEBROW APPLICATOR

[76] Inventor: William J. Chuang, 1230 Miramonte Ave., Los Altos, Calif. 94022

[21] Appl. No.: 178,538

[22] Filed: Apr. 7, 1988

[51] Int. Cl.[4] ..... A45D 40/26

[52] U.S. Cl. ..... 132/218; 132/216

[58] Field of Search ..... 132/88.5, 218, 216, 132/319, 320, 53

[56] References Cited

U.S. PATENT DOCUMENTS

| | | | |
|---|---|---|---|
| 2,628,626 | 2/1953 | Teillaud | 132/88.5 |
| 2,998,821 | 9/1961 | Hurdel | 132/88.7 |
| 3,568,684 | 3/1971 | Reece | 132/333 |
| 3,598,685 | 8/1971 | Lee et al. | 132/73 |
| 4,024,879 | 5/1977 | Stryker | 132/88.5 |
| 4,611,611 | 9/1986 | Beal Jr. | 132/88.7 |

*Primary Examiner*—Gene Mancene
*Assistant Examiner*—Adriene J. Lepiane

[57] ABSTRACT

A simulated eyebrow applicator, comprises a sheet of thin material, a pair of simulated eyebrows formed thereon, a plurality of adhesive areas on the sheet of thin material, and a corrugated part or an extendable part. The applicator can be adhered to the face with the adhesive areas after the distance between the simulated eyebrows is adjusted with the corrugated part or the extendable part. Then the simulated eyebrows can be rubbed-pressed to the face.

4 Claims, 1 Drawing Sheet

FIG. 1
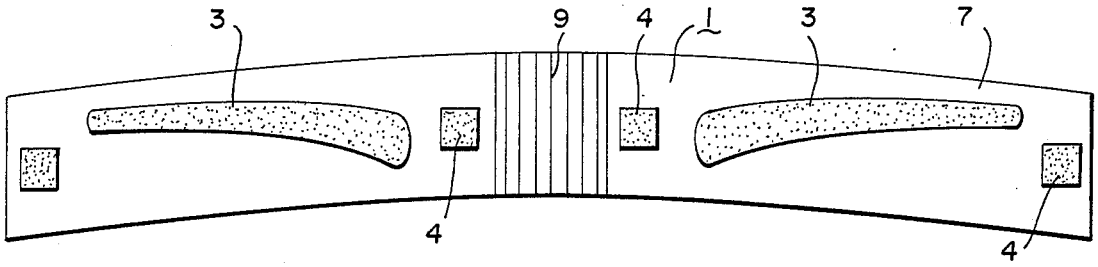
FIG. 2
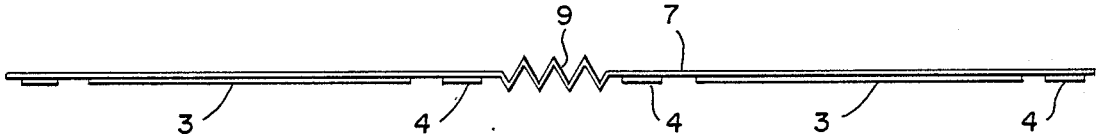
FIG. 3
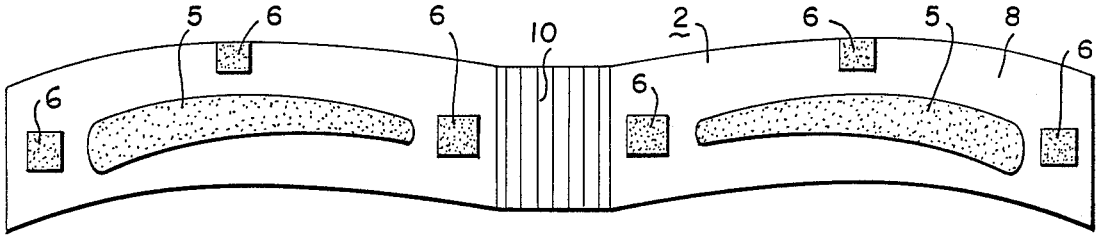
FIG. 4
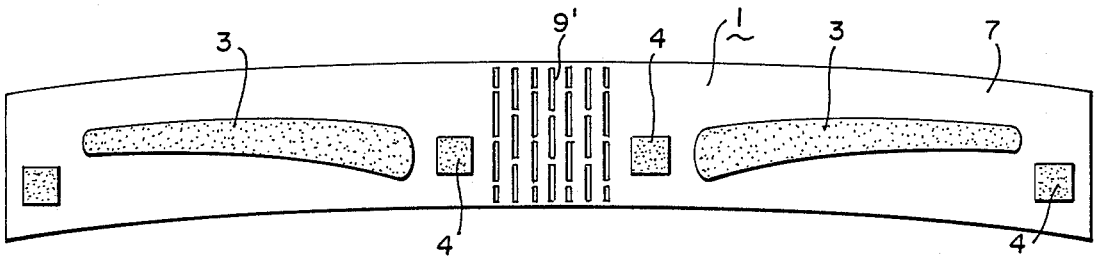
FIG. 5
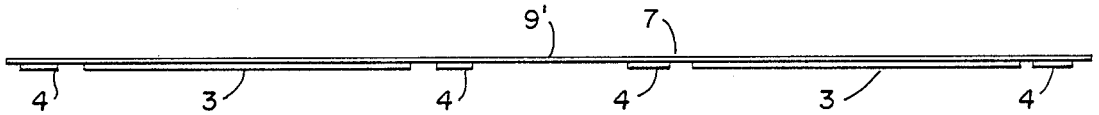
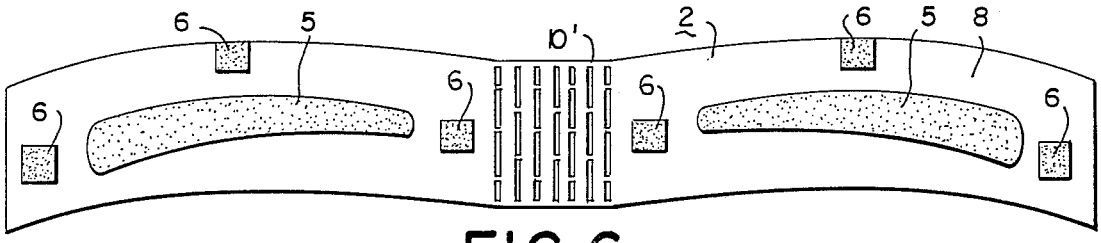
FIG. 6

SIMULATED EYEBROW APPLICATOR

This invention relates to the field of applicators of simulated eyebrows, particularly to applicators made of pieces of sheet-like material such as plastic paper for use by individuals to apply simulated eyebrows to their face.

Eyebrow pencils or crayons are widely used by women to beautify their eyebrows. However, it is difficult to shape both eyebrows identically but oppositely, and as a result, one eyebrow may be slightly larger than, or shaped differently from the other. Furthermore, one or more edges may be left ragged. This contributes to an unattractive appearance of the eyebrows.

Stryker U.S. Pat. No. 4,024,879, Peck U.S. Pat. No. 2,842,142 and Hurdel U.S. Pat. No. 2,998,821 depict some devices for beautifying eyebrows. Besides, Beal, Jr. U.S. Pat. No. 4,611,611, Lee et al 3,598,685, Gibert 2,248,533, and Feinstein 2,735,435 illustrate various devices for beautifying lips or nails.

The present invention provides applicators made of pieces of sheet-like material such as plastic paper, having desirable eyebrow shapes of paints which are transferable to a desired position on the face to beautify the eyebrows. Furthermore, the applicators have a corrugated portion or an extendable portion at the central part of the sheet-like material so as to adjust the distance between the eyebrow shapes of paints. Also, the applicators have a plurality of portions having adhesives applied thereon for temporarily adhering the applicators to the faces as the eyebrow shapes of paints are transferred to the faces.

Other objects will appear from the following description, the claim appended thereto, and from the annexed drawings, in which like reference characters designate like parts throughout the several views, and wherein:

FIG. 1 is an elevational view of a first embodiment of the present invention;

FIG. 2 is a top schematic view of the applicator shown in FIG. 1;

FIG. 3 is an elevational view of a second embodiment of the present invention; and FIGS. 4–6 are similar to FIGS. 1–3 and show a third and a fourth embodiment of the present invention.

Referring now to FIGS. 1 and 2, the simulated eyebrow applicator 1 of the present invention comprises mainly a sheet 7 of thin material, preferably transparent or translucent flexible plastic paper. A pair of simulated eyebrows 3 formed of paint, pigment, crayon, or the like, is releasably coated on the sheet 7. A plurality of areas 4 are coated with adhesives which in turn is covered with a protective layer (e.g., release paper), not shown in the drawing, which can be peeled off when the applicator 1 is to be used. The central portion of the sheet 7 is formed with a corrugated part 9 with a plurality of fold lines thereon.

Similarly, in the second embodiment shown in FIG. 3, the simulated eyebrow applicator 2 comprises a sheet 8, a pair of simulated eyebrows 5, a plurality of adhesive areas 6, and a corrugated part 10.

Similarly, FIGS. 4 and 5 show a third embodiment in which the corrugated part 9 in FIG. 1 is replaced by an extendable part 9' which can be extended longitudinally.

FIG. 6 shows a fourth embodiment in which the corrugated part 10 in FIG. 3 is replaced by an extendable part 10' which can be extended longitudinally.

The manufacturer of the present invention can put an applicator 1 or 2, a plurality of applicators 1, 2, the combination thereof, or applicators having different shapes of simulated eyebrows, into a bag, a box or case, with a plurality of protective film (not shown in the drawings) interposed therebetween, so that a smearing between the applicators can be prevented. The simulated eyebrows 3 and 5 can be of any desirable color. Each of the eyebrows 3 or 5 can be of one, or more than one color in themselves.

The user can peel off the protective layer covering the adhesive areas 4 or 6, bring the applicator near the eyebrows or the original position of eyebrows thereof, adjust the distance between the pair of the simulated eyebrows 3 or 5, by extending or collapsing the corrugated part or the extendable part, adhere the applicator to the face with the adhesive areas 4 or 6 stuck to the face, and rub-press (with finger) the part of the simulated eyebrows 3 or 5 from the other side (i.e., upper side of the sheet 7 in FIG. 2). Then the paint, pigment, crayon, or the like can be transferred to the face to form simulated eyebrows. Thereafter, the applicator can be removed from the face.

What is claimed is:

1. A simulated eyebrow applicator, comprising:

a sheet of thin material of a width at least equal to two eyebrows of a human being;

a pair of simulated eyebrows having an inner end and an outer end and symmetrically and transversely formed on the sheet of thin material, with a space left between the inner end of the said eyebrows;

a plurality of foldings formed on the sheet of thin material at the space left between the inner ends of the said eyebrows so as to form a corrugated part; and a plurality of adhesive areas formed on the sheet of thin material on the same face having the simulated eyebrows formed thereon and at the places between the inner ends of the said eyebrows and the corrugated part, and at the places near the outer ends of the said simulated eyebrows;

whereby the simulated eyebrow applicator can be brought near the eyebrows or the original position of eyebrows of a user by two hands of the user, the distance between the pair of the said simulated eyebrows can be adjusted by extending or collapsing the corrugated part, the applicator can be adhered to the face of the user with the plurality of adhesive areas stuck to the face of the user; and the said simulated eyebrows can be transferred from the sheet of thin material to the face of the user.

2. The simulated eyebrow applicator according to claim 1, wherein the simulated eyebrows are formed of paints, pigment, crayon, or the like.

3. A simulated eyebrow applicator, comprising:

a sheet of thin material of a width at least equal to two eyebrows of a human being;

a pair of simulated eyebrows having an inner end and an outer end and symmetrically and transversely formed on the sheet of thin material, with a space left between the inner end of the said eyebrows;

a plurality of cutout portions formed on the sheet of thin material at the space left between the inner ends of the said eyebrows so as to form an extendable part;

a plurality of adhesive areas formed on the sheet of thin material on the same face having the simulated eyebrows formed thereon and at the places between the inner ends of the said eyebrows and the extendable part, and at the places near the outer ends of the said simulated eyebrows;

whereby the simulated eyebrow applicator can be brought near the eyebrows or the original position of eyebrows of a user by two hands of the user, the distance between the pair of the said simulated eyebrows can be adjusted by extending or collapsing the extendable part, the applicator can be adhered to the face of the user with the plurality of adhesive areas stuck to the face of the user; and the said simulated eyebrows can be transferred from the sheet of thin material to the face of the user.

4. The simulated eyebrow applicator according to claim 3, wherein the simulated eyebrows are formed of paints, pigment, crayon, or the like.

* * * * *